US008650677B2

(12) United States Patent
Altena et al.

(10) Patent No.: US 8,650,677 B2
(45) Date of Patent: Feb. 18, 2014

(54) HOIST PROVIDED WITH A CLAMPING DEVICE FOR MOVING PERSONS

(75) Inventors: Willem Altena, Hengelo (NL); Jozef Huizinga, Wedde (NL)

(73) Assignees: Indes Holding B.V., Enschede (NL); Joyincare Group B.V., Wedde (NL)

( * ) Notice: Subject to any disclaimer, the term of this patent is extended or adjusted under 35 U.S.C. 154(b) by 544 days.

(21) Appl. No.: 12/937,497

(22) PCT Filed: Apr. 14, 2009

(86) PCT No.: PCT/NL2009/050200

§ 371 (c)(1), (2), (4) Date: Nov. 24, 2010

(87) PCT Pub. No.: WO2009/126040

PCT Pub. Date: Oct. 15, 2009

(65) Prior Publication Data

US 2011/0056019 A1 Mar. 10, 2011

(30) Foreign Application Priority Data

Apr. 11, 2008 (NL) ..... 2001474

(51) Int. Cl.
*A61G 7/14* (2006.01)
*A61G 7/10* (2006.01)

(52) U.S. Cl.
CPC ..... *A61G 7/1017* (2013.01)
USPC ..... 5/87.1; 5/86.1; 5/81.1 R; 5/83.1

(58) Field of Classification Search
USPC ..... 5/81.1, 83.1, 84.1, 85.1, 86.1, 87.1, 5/88.1, 89.1
See application file for complete search history.

(56) References Cited

U.S. PATENT DOCUMENTS

| | | | | | |
|---|---|---|---|---|---|
| 3,596,298 | A * | 8/1971 | Durst, Jr. | ..... | 5/87.1 |
| 3,996,632 | A * | 12/1976 | Bakker nee Viel | ..... | 5/83.1 |
| 4,141,094 | A * | 2/1979 | Ferguson et al. | ..... | 5/85.1 |
| 5,001,789 | A * | 3/1991 | Schoenberger | ..... | 5/87.1 |
| 5,185,895 | A * | 2/1993 | Gagne et al. | ..... | 5/86.1 |
| 5,411,044 | A | 5/1995 | Andolfi | | |
| 5,502,851 | A * | 4/1996 | Costello | ..... | 5/86.1 |
| 5,892,180 | A * | 4/1999 | Carey | ..... | 177/144 |
| 6,175,973 | B1 * | 1/2001 | Hakamiun et al. | ..... | 5/89.1 |

(Continued)

FOREIGN PATENT DOCUMENTS

| | | | |
|---|---|---|---|
| DE | 202 17 673 | U1 | 2/2003 |
| DE | 20217673 | U1 * | 2/2003 |
| EP | 0 782 430 | A | 9/1996 |

*Primary Examiner* — William Kelleher
*Assistant Examiner* — David R Hare
(74) *Attorney, Agent, or Firm* — Birch, Stewart, Kolasch & Birch, LLP

(57) ABSTRACT

A hoist for moving persons, provided with a base structure, provided with one lifting column having a straight longitudinal axis and a lower end and which is provided with a first actuator for realizing a lifting movement, provided with a clamping device which is connected to the lifting column so as to be movable in the direction of the longitudinal axis and has at least one set of cooperating clamping elements which are designed for clamping a person to be moved, provided with a horizontal shaft by which the lifting column is pivotally connected to the base structure, and provided with a second actuator connected to the lifting column and to the base structure, and configured for varying the pivotal position of the lifting column with respect to the base structure.

18 Claims, 6 Drawing Sheets

(56) References Cited

U.S. PATENT DOCUMENTS 6,389,619 B1 * 5/2002 Dunn ..... 5/86.1
7,392,554 B1 * 7/2008 Su et al. ..... 5/86.1
2006/0097557 A1 * 5/2006 Tholkes et al. ..... 297/330
2006/0213007 A1 9/2006 Palay et al.
2010/0154117 A1 * 6/2010 Odashima et al. ..... 5/87.1

* cited by examiner

HOIST PROVIDED WITH A CLAMPING DEVICE FOR MOVING PERSONS

FIELD

The invention relates to a hoist provided with a clamping device for moving persons.

BACKGROUND

For many care workers, lifting less able-bodied person is a daily often recurring basic operation. In order to limit the physical stress for the care workers, manual lifting has been reduced in particular the last ten years, and is replaced with the use of so-called hoists, with which care-needing persons can be moved relatively efficiently from a seated position to a standing position and vice versa.

EP-A-0 782 430 describes an example of a hoist known from the state of the art. During use of the hoist described in this publication, first, a lifting belt forming part of the hoist is passed behind the back and under the armpits of a person to be moved, whereupon the person can be moved. The hoist is provided with an articulate arm comprising a lever which is hingedly connected, by a first end, to a frame and is hingedly connected, by a second end, to an auxiliary arm. The free ends of the auxiliary arm are provided with points of attachment for a lifting belt. The specification describes that the path the points of attachment travel is controlled by a control unit in which different control programs can be stored for realizing different paths. An important drawback of the known hoist is that the person still has a relatively large freedom of movement after the lifting belt is provided, so that during moving, the person is secured to a limited extent only. This may lead to unsafe situations which limits the usability of the known hoist considerably. The path the person travels is not well defined in that the lifting belt offers great freedom of movement. Furthermore, it is frightening for the user to be "suspended" in such a movable lifting belt. In addition, as a rule, persons suffering from, for instance, hemiplegia or hemiparesis will engage the hoisting belt in an askew condition so that the persons to be moved are usually loaded and moved in an unnatural and often incorrect manner.

U.S. Pat. No. 3,596,298 and U.S. Pat. No. 5,411,044 show hoists with armpit supports. Each armpit support is connected to the upward directed end of a telescopic lifting column which is movable upward and downward relative to a base. Furthermore, each telescopic arm is pivotal with respect to the base. A drawback of the known apparatus is that a considerable part of the lifting force is exerted on the armpits, which is painful.

DE-U-202 17 673 describes a hoist for patients, provided with two padded armpit supports which engage the ribcage of the patient with a particular clamping force, while avoiding too strong a clamping force and wherein the patient is also prevented from gliding from the clamping device. The clamping direction is movable obliquely upward and downward along a fixedly disposed guide path. Therefore, with the apparatus known from this publication, only a single lifting movement is possible.

What is envisaged is a hoist with which the above-described drawbacks are reduced or solved.

SUMMARY OF THE INVENTION

To that end, a hoist for moving persons is provided, which is provided with:

- a base structure
- one lifting column having a straight longitudinal axis and a lower end and which is provided with a first actuator for realizing a lifting movement;

- a clamping device which comprises:
  - a bearing frame connected to the lifting column, such that the bearing frame and hence the clamping device is movable parallel to the longitudinal axis with the aid of the first actuator;
  - at least one set of cooperating clamping elements connected to the bearing frame and designed for clamping a person to be moved, wherein at least one clamping element of the set is pivotally connected to the bearing frame, and
  - driving means connected to the bearing frame and to the at least one pivotal clamping element, designed for pivoting the at least one pivotal clamping element in the direction of the person for actively clamping the person with the cooperating clamping elements;
- a horizontal shaft with which the lifting column is pivotally connected to the base structure; and
- a second actuator connected to the lifting column and to the base structure, and configured for varying the pivotal position of the lifting column with respect to the base structure.

Such a hoist gives the person it can bring from a seated to a standing position and vice versa a more secure feeling and a more natural sensation than the hoists known heretofore. This means a sensation that corresponds best to the sensation that occurs when the respective person is brought from a seated to a standing position by a care worker.

The clamping elements that engage both sides of the chest have the function of the hands of a care worker. Contrary to armpit supports, the bearing force is specifically transmitted through clamping. The fact that the lifting column is pivotally connected to the base structure and that the clamping device itself is movable upward and downward along the longitudinal axis of the lifting column provides the possibility for the clamping device to travel a natural path. A natural path is understood to mean a path the trunk of a person preferably travels during standing up.

In one embodiment, the hoist comprises a control which is configured for controlling the first actuator and the second actuator for moving a clamped person along a natural path from a seated position to a standing position and vice versa.

With such an embodiment, the control and the first and the second actuator can be configured for providing the natural path in the form of a smooth path.

Here, from the seated position to the standing position, the smooth path can comprise a first path part which, viewed from the patient, is directed forward and obliquely upward or, alternatively, forward and substantially horizontally, and the smooth path can comprise a second path part contiguous to the first path part which is directed substantially vertically, while the transition between the first path part and the second path part is smooth.

Such a configuration of the path resembles the natural raising movement of a healthy person when standing up independently the most. As the clamping elements directly engage the user, the user too will be brought accurately and securely, as if being helped by a care worker, from the seated to the standing position.

In one embodiment, the control can be provided with a memory in which a number of preprogrammed paths are stored.

Depending on the condition of the patient, a more passive or more active path can be selected. In general, the active path will be directed more obliquely upward, while a passive path will first be directed substantially horizontally forward and only then upwards.

Through the use of the clamping elements which, through the driving means, actively exert a force on the person, the overall freedom of movement for the person is minimized, so that the person can be moved in a relatively reliable and safe manner with the aid of the hoist comprising the clamping device. Here, actively exerting a force on the clamping elements prevents the clamping elements from detaching the person to be moved, which is additionally beneficial to the safety. The improved active securing of the person to be moved will furthermore be to the advantage of the usability of the hoist. As a rule, the clamping elements can be removed from the person only after the force exerted by the driving means on the clamping elements is overcome, whereby deactivation of the driving means takes place. As a rule, deactivating the driving means will be realized by a care worker. As, through the use of the clamping means, the clamping device will in fact grasp the person to be moved in a location-selective manner, a large part of the body of the person to be moved will remain accessible to care workers, which facilitates the physical care of the person both with regard to the care worker and the person needing care. Furthermore, it can thus be guaranteed that the person to be moved is correctly loaded and is moved even when this person would suffer from hemiplegia or hemiparesis. As a rule, the clamping elements will be designed for engaging the person to be moved at parts of the body such as, for instance, the trunk under the armpits, where the care worker would also engage the person for moving the person, so that the person will experience a large degree of familiarity when being clamped.

During movement, the clamping elements will engage the person continuously, irrespective of the fact whether the person contributes to the realization of the moving. As a rule, a set of cooperating clamping elements comprises two, three or four clamping elements which are designed for engaging the same specific body part of the person, such as, for instance, the trunk, the arms, the legs, etc. It is also conceivable, and in certain situations even especially advantageous, when the clamping device comprises several sets of cooperating clamping elements, where a first set of clamping elements may be designed for engaging the legs of the person and a second set of clamping elements may be designed for engaging the chest of the person. In a preferred embodiment, the mutual orientation between two sets of clamping elements is adjustable, so that a person can be moved relatively simply, safely and efficiently between two conditions, in particular a lying condition and a seated condition. It is, for that matter, conceivable to market the clamping device as separate device. Furthermore, it is conceivable that the clamping device is first provided on a person, after which the clamping device will be connected to a (remaining part of a) hoist.

In one embodiment, the driving means of the clamping device comprise at least one first driving element for moving the at least one clamping element against the person to be moved, and the driving means comprise at least one second driving element for exerting a force directed towards the person to be moved on the clamping element positioned against the person to be moved for active clamping of the person. By effecting the clamping of the person in the clamping device in a phased manner, by first having the clamping elements clamp the person under a (limited) bias under the influence of the at least one first driving element and by then realizing the actual clamping by having the clamping elements engage the person under a relatively great bias, the clamping elements can first be correctly positioned against the person to be moved in a relatively user friendly manner, whereupon this person can then be effectively clamped. With the actual clamping of the person, the total clamping force will, as a rule, be determined by the at least one second driving element. When several pivotal clamping elements are used, it is advantageous when each pivotal clamping element is connected to its own first driving element, so that the clamping elements can be provided on the person independently of each other. As a rule, the at least one second driving element will be designed for simultaneously exerting a force on all pivotal clamping elements, so that the clamping elements will engage the person with a substantially constant force, even when the form and/or dimensioning of the body part of the person on which the clamping element engage changes during movement of the person. Here, the person can be clamped in a substantially symmetrical manner as well as in an asymmetrical manner, while this all will generally depend on the build of the person to be moved. As driving elements, for instance, pneumatic and/or hydraulic springs can be used. However, it is also conceivable that the driving means comprise electromechanical and/or electromagnetic elements for having the clamping means exert a force on the person to be moved. It is advantageous when the first driving element and the second driving element are designed to be brought in an active condition independently of each other, where a force directed towards the person is exerted on the at least one pivotal clamping element. Separately activating the first driving element or second driving element, respectively, has as an advantage that the phased clamping of the person as described hereinabove can be realized efficiently. Use of several driving elements has as an advantage that a permanently exerted force on a person can be guaranteed, even when one of the driving elements were to inadvertently deactivate or be deactivated.

Preferably, the clamping device comprises locking means for locking and unlocking the driving means. Use of the locking means has as an advantage that two stable conditions can be realized: a non-operative condition, in which the clamping elements are not positioned such that a person can be clamped and an operative condition, in which the clamping elements are positioned such that a person can be clamped. By selectively locking or unlocking the at least one pivotal clamping element with the locking means, one of the above-mentioned conditions of the clamping device can be achieved. Here, it is advantageous when the driving means are designed for exerting, with the driving means in the unlocked condition, a force on the at least one pivotal clamping element. When the locking means dysfunction, the clamping elements will be forced towards the operative (clamping) condition which is important to the safety of the person. In addition, as a result, unintentionally removing the clamping means can be avoided as much as possible which is also of importance from the viewpoint of safety. As a rule, only after overcoming the force exerted by the driving means the at least one pivotal clamping element can be brought to the non-operative condition, after which the person can be uncoupled from the clamping device according to the invention. In a special preferred embodiment, the locking means are designed for separate locking and unlocking of the first driving element and the second driving element, which is beneficial to the phased clamping of a person to be moved as described hereinabove.

In one embodiment, the first driving element can comprise for each clamping element, a third telescopic actuator associated with the respective clamping element, which actuator is connected, by a first end, to the bearing frame and, by the other end, to the clamping element, the third actuator having a collapsed and an extended position between which the intermediate positions are located, the third actuator being provided with locking means for locking the third actuator in an intermediate position. A relatively inexpensive, robust design can be realized when the third actuators are designed as gas springs as utilized also with, for instance, office chair frames. These office chair gas springs too are provided with locking means for locking the telescopic gas spring in an intermediate position. In one embodiment, the second driving element can be provided with:

a shaft, rotatably connected to the bearing frame and having a first eccentric lobe and at least one second eccentric lobe associated with the at least one clamping element, the first end of the third actuator associated to the clamping element being connected, via the second lobe, to the bearing frame;

a fourth telescopic actuator which is connected by a first end to the first eccentric lobe and is connected by a second end to the bearing frame;

while, with the fourth actuator in a first condition, the shaft has a rotational position such that with each third actuator in a locked condition, the greater force directed towards the person to be moved is exerted on the clamping element, while, with the fourth actuator in a second condition, the shaft has a rotational position such, with each third actuator in a locked condition, that the force substantially corresponds with the force exerted by the at least one third actuator on the clamping element, should this third actuator be in the unlocked condition.

In a preferred embodiment, the at least one set of cooperating clamping elements comprises at least two clamping elements pivotally connected to the bearing frame, the driving means being designed for pivoting the pivotal clamping elements in the direction of the person while clamping the person, while the pivots of the pivotal clamping elements extend substantially parallel to the straight longitudinal axis of the lifting column.

By pivotably connecting the cooperating clamping elements to the bearing frame, as a rule, the accessibility of the clamping device for the person can simply be enhanced. Furthermore, in this manner, it can be realized that several, and preferably all, clamping elements exert a (direct) active force on the person which will further increase the safety of the clamping device. As the clamping elements are pivotal independently of each other, it is also enabled to clamp the person to be moved with the clamping apparatus in an eccentric manner, which can be desirable with particular persons.

Preferably, the at least one clamping element, and more preferably each clamping element, comprises an arm and a pad connected to the arm, the pad being designed for engaging the person to be moved. Preferably, the pad is provided with a design tailored to the body of the person, so that a tight fit of the pad on the person can be realized. As a rule, a part of the pad facing the person will thereto be at least of partly concave design. Here, it can be advantageous to design the part of the pad facing the person asymmetrically in order to adjust this design as much as possible to the actual form of the body of the person. It is also conceivable that at least a part of the pad facing the person is of substantially flexible design in order to further optimize the fit of the pad to the body, which is beneficial both to the safety of the clamping device and to the comfort of the person. In a special preferred embodiment, the pad is provided with at least one inflatable or inflated compartment, which is further beneficial to a tight and comfortable fit of the pad to the body.

In a preferred embodiment, the orientation of the pad relative to the arm is adjustable. It is furthermore preferred that the pad is connected to the arm so as to be freely rotatable, so that the clamping elements can remain substantially engaged on the person when the arms of the clamping device are moved relative to the person, which enhances the comfort of the person and the safety of the clamping device. However, it is also conceivable here that the free rotation of the pads is limited in order to prevent the pad from being provided in a non-optimal condition on the person to be moved, for instance upside down. It is advantageous when the pad is detachably connected to the arm, for replacing the pad in a relatively simple manner with, for instance, another pad or lifting belt, which is beneficial to the flexibility of the usability of the hoist.

The invention also provides a hoist comprising:

a bearing frame;

a first set of clamping elements connected to the bearing frame and configured for engaging of the trunk in a clamping position and for releasing the trunk in a releasing position;

a second set of clamping elements connected to the bearing frame and configured for engaging the upper legs in a clamping position and for releasing the upper legs in a releasing position;

wherein the position of the first set of clamping elements, at least when it is in the clamping position, is adjustable with respect to the position of the second set of clamping elements, at least when it is in the clamping position, such that a clamped patient can be brought from a seated to a lying position and vice versa.

To the present day, when lifting patients in a passive manner, use is made of hoist belt assemblies. With such hoist belt constructions, it is not possible to bring the patient during lifting from a seated to a lying position. By now providing two sets of clamping elements whose mutual position, at least in a clamped condition, can be adjusted, a patient can for instance be clamped in a seated position, then be brought to a lying position and then be laid on a bed with the aid of the hoist. With such a hoist, the mutual position of the sets will, in general, also be adjustable when the camping elements of the sets are not in the clamping position. The fact is that the hoist should be able to take up a patient both from a seated position and from a lying position. With the hoist with several sets of clamping elements which are mutually movable, it is possible that still one further set of clamping elements is present for engaging other parts of the body, for instance the lower legs and/or the pelvis. In this context, the term hoist is understood to mean an apparatus whose frame can be wheeled over the floor. The hoist can also be a ceiling lift, with the frame movable along a rail on the ceiling. A stationary bearing frame is a possibility too.

The invention also provides a method for moving persons, comprising:

providing a hoist according to the invention;

having the clamping elements engage a person to be moved;

having the driving means exert a force directed towards the person on the at least one pivotal clamping element while clamping the person, and moving the person clamped by the clamping elements.

During clamping, the force exerted on the at least one pivotal clamping element is transmitted by the clamping element on the person to be clamped. When the at least one set of clamping elements also comprises a stationary (not pivotal) clamping element, the force exerted on the person by the pivotal clamping element will be transmitted to the stationary clamping element. The at least one actively clamping pivotal clamping element and the at least one reactively clamping stationary clamping element result in a reliable clamping of the person. Preferably, the set of clamping elements comprises only pivotal clamping elements so that all clamping elements actively exert a force on the person to be moved, which is beneficial to the reliability of the clamping and the comfort for the person during clamping. In a preferred embodiment, the driving means have the clamping elements engage the person under a (limited) bias when the clamping element engages a person to be moved, so that the clamping elements can be arranged efficiently on the person and be held in the correctly arranged orientation condition under the influence of the imposed bias.

In a preferred embodiment, during engaging, at least one first driving element of the driving means is unlocked for having the clamping means engage the person under a bias. Preferably, during the successive/subsequent clamping, the at least one first driving element is locked and the at least one second driving element of the driving means is unlocked for having the driving means exert a force directed towards the person on the at least one pivotal clamping element, while clamping the person. As a rule, from a point of view of safety, it is particularly advantageous, through unlocking of the first driving element and/or the second engaging elements, to have a (direct) force exerted on the pivotal clamping elements and hence on the person, as the risk of unintentionally uncoupling the clamping element with respect to the person is thus minimized as much as possible.

The invention will be further elucidated on the basis of non-limitative exemplary embodiments represented in the following Figures.

DETAILED DESCRIPTION

Figure 1:
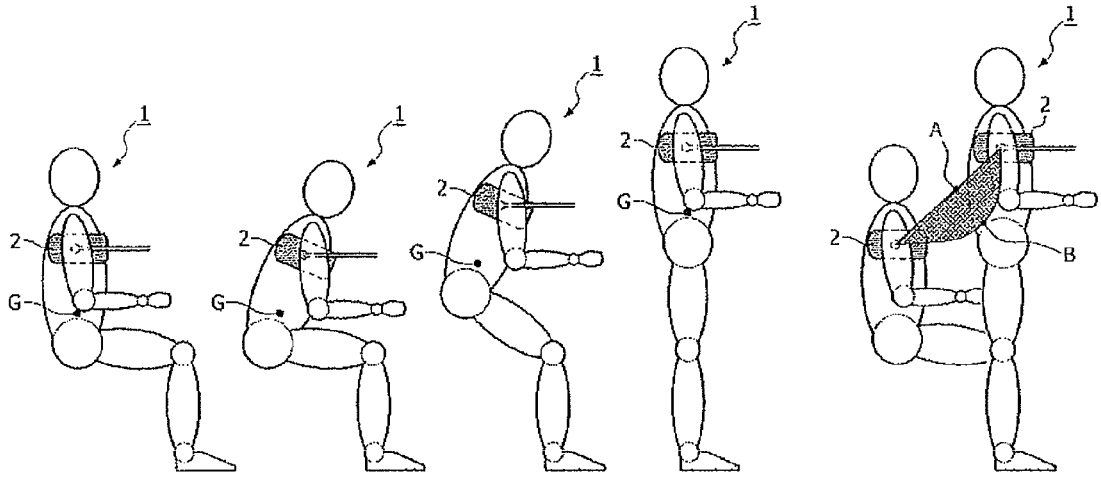
FIG. 1 shows a natural rising movement of a person.

FIG. 1 shows a natural rising movement of a person 1 which is realized with an exemplary embodiment of a hoist, while only the pads 2 forming part of the hoist and clamping the person 1 are represented. The center of gravity G of the person is also represented in this figure. For a controlled movement, first, the center of gravity G of the seated person 1 will be advanced by tilting the trunk of the person 1 relative to the pelvis of the person. Then, the person 1 will make a rising movement, with the trunk of the person 1 also pivoting in upward direction, so that the person will come to a standing position. The path the person 1 travels during rising can be varied. When the person has a relatively good equilibrium and still has some muscle power, a relatively rapid, substantially linear movement A of the pads 2 and hence of the person 1 could suffice. For a physically less stable person, a more curved, slower movement B of the pads 2 can be selected. Between this substantially linear path and the concavely curved path P are numerous paths which can also be used.

Figure 2A:
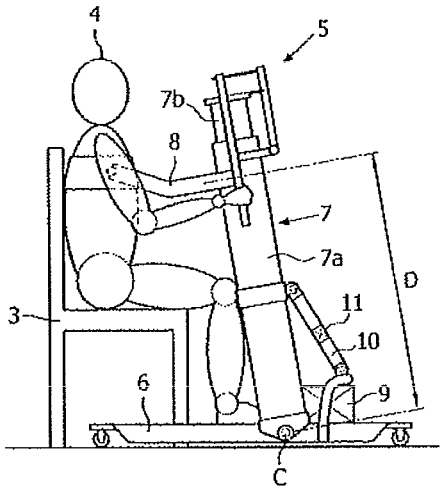
FIG. 2*a* shows a side view to a person in a seated condition and a hoist in a collapsed condition.
Figure 2B:
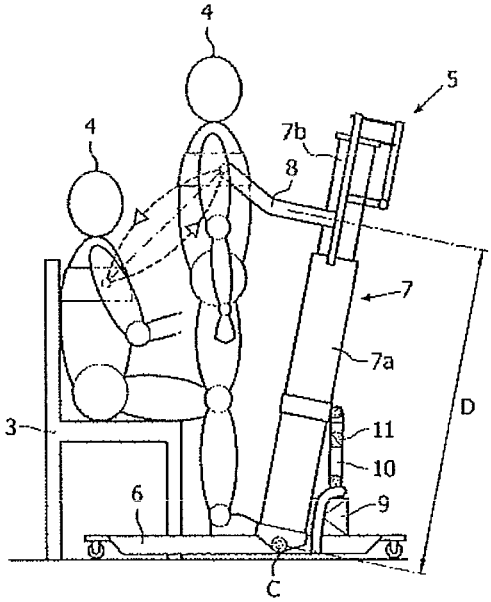
FIG. 2*b* shows a side view to the person according to FIG. 2*a* in a standing condition and the hoist according to FIG. 2*a* in an extended condition.

FIG. 2*a* shows a side view of a person 4 seated on a chair 3 and a hoist 5 in collapsed condition. The chair 3 can be formed by a separate (wheel)chair, but can also be integrally connected to a base structure 6 of the hoist 5. The hoist 5 also comprises a lifting column 7 rotatably connected to the base structure 6 about an axis of rotation C. The lifting column 7 comprises a first column segment 7*a* which is pivotally connected to the base structure 6 about the axis of rotation C. The lifting column 7 also comprises a second column segment 7*b* which cooperates telescopically with the first column segment 7*a*. In the collapsed condition shown, a substantial part of the second column segment 7*b* is enclosed by the first column segment 7*a*. The hoist further comprises a clamping device with two clamping elements 8 which is connected to the second column segment 7*b*. An exemplary embodiment of the clamping device is clarified in the following with reference to FIGS. 4*a*-4*c*. The clamping elements 8 of the clamping device are designed for clamping the trunk of the person 4. As shown, in this condition, the lifting column 7 is pivoted towards the person. During rising of the person 4, the lifting column 7 will pivot away from the person 4 about the axis of rotation C, while at least temporarily simultaneously, the lifting column 7 will extend through movement of the second column segment 7*b* with respect to the first column segment 7*a* in a direction away from the first column segment 7*a*, so that the person is moved following a natural path to a standing condition (see FIG. 2*b*). Extending the lifting column 7 is carried out by using a first actuator 9, for instance an electric motor. As a rule, in practice, the first actuator 9 will be built-in in the lifting column 7 and therefore not be visible. Pivoting the lifting column 7 relative to the base structure 6 is carried out by using a second actuator 10, for instance a telescopically operating actuator or driving rod 10. As a rule, the second actuator 10 will be connected to a separate electric motor. Through the use of separate electric motor, usually linear motors, for pivoting the lifting column 7 or collapsing or extending the lifting column 7, respectively, both movements can be controlled relatively efficiently, independently of each other, with the aid of a control. For collapsing and extending the lifting column 7, usually, use will be made of force transmitting means (not represented) positioned in the lifting column 7 such as, for instance, sprocket wheels and toothed racks. During movement of a person 4 from the seated to the standing position, the distance D between, on the one side, the clamping elements 8 of the clamping device and, on the other side, the axis of rotation C will increase. When the person 4 is to be moved with the aid of the hoist 5 from a standing position to the seated position, the lifting column 7 will be pivoted towards the person 4, while the lifting column will also collapse. The paths to be travelled by the clamping elements 8 both for standing up and for sitting down of the person 4 are represented in FIG. 2*b*.

As described hereinabove, the lifting column 7 is designed as a telescopic arm with two column segments 7*a*, 7*b* which are slideable into and from each other, with the clamping device connected to the upper column segment. In an alternative embodiment, it is also possible that the lifting column is not of telescopic design but as a guide path, so that the clamping device, more particularly a bearing frame thereof is movable upward and downward along the lifting column via the guide path. An advantage of the telescopic design of the lifting column 7 is that, in each position of the lifting column, the patient has an unobstructed view in forward direction and that the operating handles of the clamping device are freely accessible to the care worker.

Figure 3:
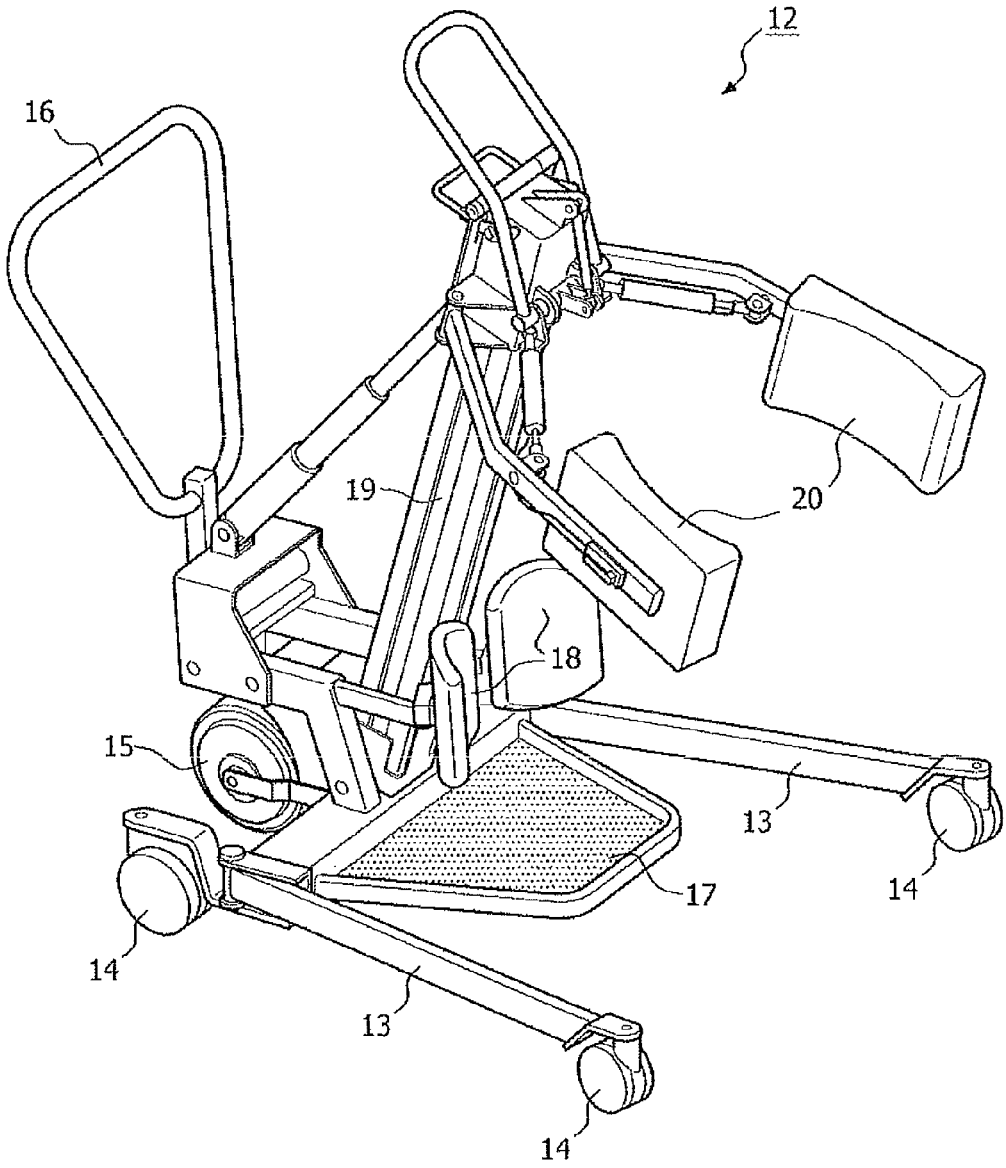
FIG. 3 shows a perspective side view to an exemplary embodiment of a mobile hoist.

FIG. 3 shows a perspective side view to an elaboration of a mobile hoist 12. The hoist 12 comprises a base structure 13 provided with several supporting wheels 14 and one drive wheel 15, which drive wheel 15 can be controlled by means of an operating handle 16 for motorized movement of the base structure 13 and hence of the hoist 12. The base structure 13 comprises a foot platform 17 and knee supports 18 on which or against which, respectively, a person to be moved can bear. The hoist 12 further comprises a lifting column 19 pivotally connected to the base structure 13, which column is provided with a clamping device with clamping elements with pads 20. The operation of the hoist 12 shown is identical to the hoist shown in FIGS. 2*a* and 2*b*. With the aid of the lifting column 19, a clamped person can be moved following a natural path from a seated position to a standing position and vice versa.

Figure 4A:
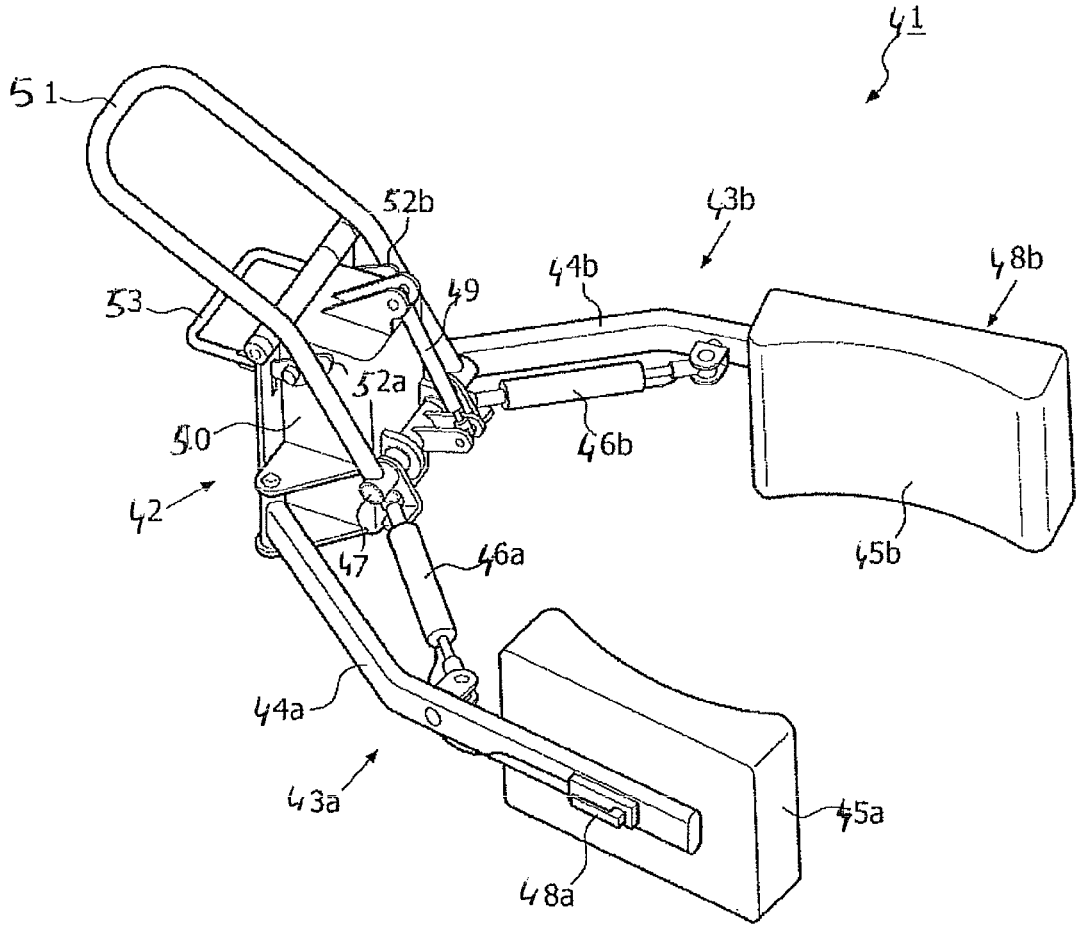
FIGS. 4*a*-4*c* show perspective views to an exemplary embodiment of a clamping device in different conditions.
Figure 4B:
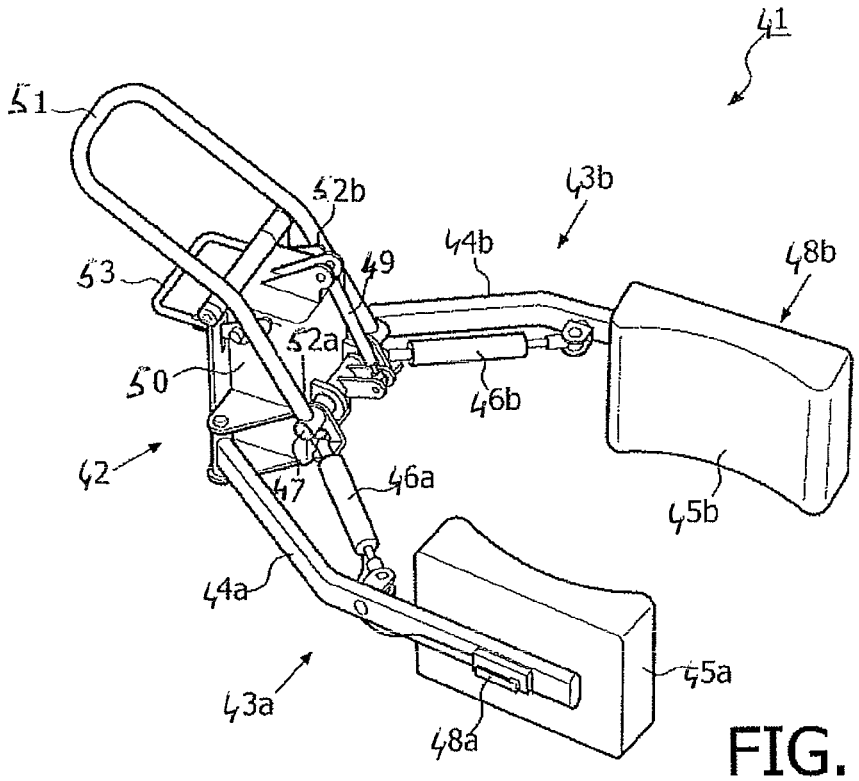
Figure 4C:
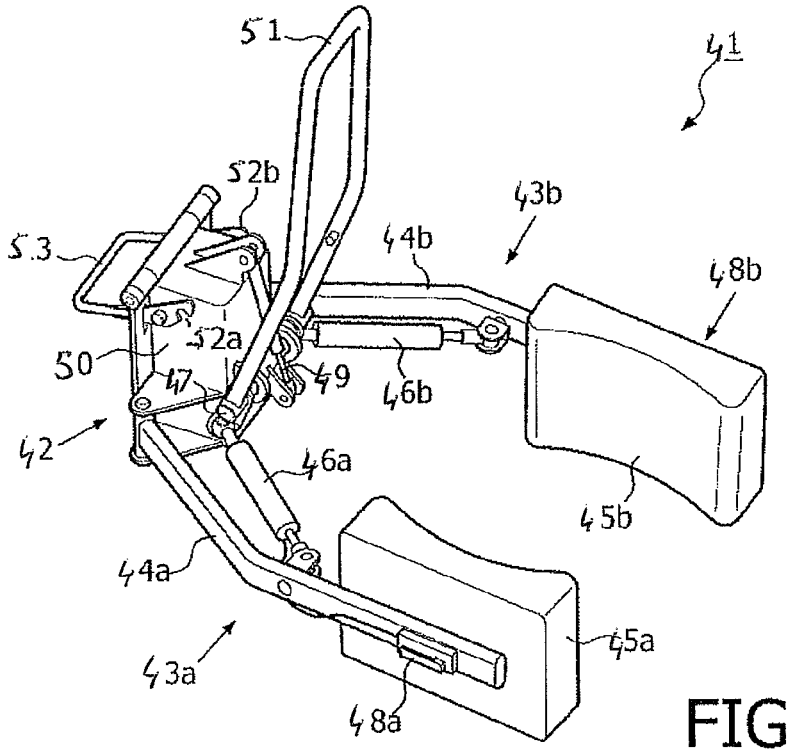

FIGS. 4*a*-4*c* show perspective views to a clamping device 41 according to the invention in different conditions. The clamping device 41 comprises a bearing frame 42, and two clamping elements 43*a* 43*b*, pivotally connected to the bearing frame 42. Each clamping element 43*a*, 43*b* comprises an arm 44*a*, 44*b*, and a pad 45*a*, 45*b* connected in a freely rotatable manner to the arm 44*a*, 44*b*. The pads 45*a*, 45*b* are designed for engaging a body of a care-needing person. The clamping device 41 also comprises two (gas)draw springs 46*a*, 46*b*, while each draw spring 46*a*, 46*b* is connected, on the one side, to an arm 44*a*, 44*b* associated therewith and is connected on the other side to a second eccentric lobe of an axially rotatable drive shaft 47 forming part of the bearing frame 42. The draw springs 46*a*, 46*b* are designed for moving the clamping elements 43*a*, 43*b* towards the person so that the pads 45*a*, 45*b* can be placed in an appropriate manner against the person to be moved. The draw springs 46*a*, 46*b* are independently of each other manually unlockable by means of two first operating handles 48*a*, 48*b*. In order to realize a firm clamping of the person, the clamping device 41 further comprises a (gas)draw spring 49 which is connected, on one side, with a stationary part 50 of the bearing frame 42 and connected, on the other side, to a first eccentric lobe of the axially rotatable drive shaft 47 of the bearing frame 42. The clamping device 41 further comprises a second operating handle 51 connected to the drive shaft 47, which second operating handle 51 can be locked by means of two locking elements 52*a*, 52*b* with respect to the stationary part 50 of the bearing frame 42. The locking elements 52*a*, 52*b* are mutually connected by means of a third operating handle 53.

The operation of the clamping device 41 can be described as follows. In the condition shown in FIG. 4*a*, the arms 44*a*, 44*b* are represented in an extreme position. In this condition, the person to be moved can be positioned between the arms 44*a*, 44*b* and in particular between the pads 45*a*, 45*b*. Then, the first operating handles 48*a*, 48*b* are squeezed by, for instance, a care worker for unlocking the draw springs 46*a*, 46*b* so that the arms 44*a*, 44*b* will pivot in the direction of the person (FIG. 4*b*) and will exert a slight bias of, for instance, 1 kg on the person. The operating handles 48*a*, 48*b* will be released again so that the draw springs 46*a*, 46*b* are locked in this intermediate position. This quasi stable condition is particularly suitable for positioning the pads 45*a*, 45*b* against the person in a correct manner. After positioning the pads 45*a*, 45*b* against the person, the clamping device 41 can clamp the person in a (substantially) firmer manner by unlocking the second operating handle 51 through downward pivoting of the third operating handle 53 with respect to the stationary part 50 of the bearing frame 42. The result of the unlocking of the second operating handle 51 is that, as a result of rotation of the drive shaft 47*m* through the tension spring 49, the second operating handle 51 will pivot in upward direction. The rotation of the drive shaft 47 also effects that the arms 44*a*, 44*b* are pulled closer together and the person will thus be more firmly clamped (FIG. 4*c*). In this clamped condition, for instance a pressure of approximately 10 kg can be exerted on the person, so that a solid clamping of the person is realized and the person can thus be moved in a secure manner. When the person is to be uncoupled from the clamping device 41, a care worker will pull the second operating handle 51 in downward direction until it is locked by the locking elements 52*a*, 52*b*. Then, the draw springs 46*a*, 46*b* can be deactivated with the aid of the first operating handles 48*a*, 48*b*, insofar as this has not already happened, after which the arms 4*a*, 4*b* can be moved apart and the person can remove himself from the clamping device 1.

Figure 5A:
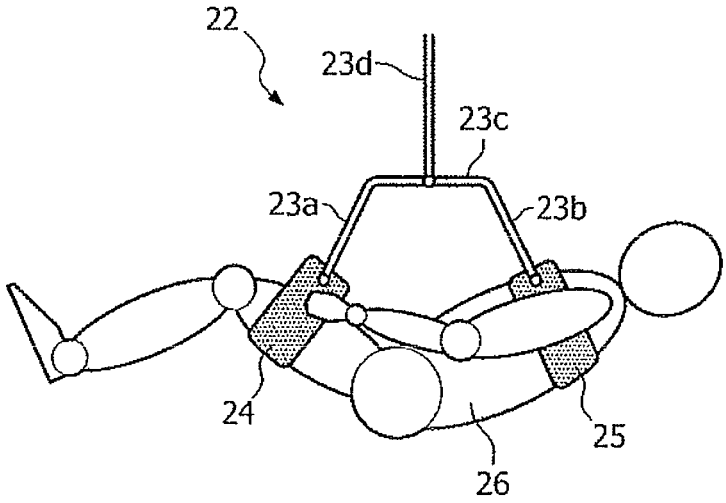
FIGS. 5*a* and 5*b* show schematic side views to an alternative exemplary embodiment of a clamping device in different conditions.
Figure 5B:
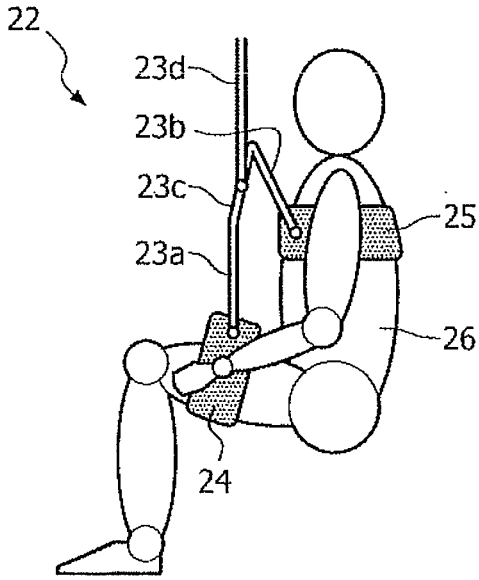

FIGS. 5*a* and 5*b* show schematic side views to an alternative embodiment of the clamping device 22 in different conditions. The clamping device 22 comprises a bearing frame 23 built up from several mutually pivotally connected bearing segments 23*a*-23*d*. The clamping device 22 further comprises two pairs of clamping elements 24, 25 while each pair of clamping elements 24, 25 is freely rotatably connected to a respective bearing segment 23*a*, 23*b*. By realizing a solid clamping of a person 26 as described in detail in the above, a clamped person can be moved in a relatively reliable manner, for instance between a lying condition (FIG. 3*a*) and a seated condition (FIG. 3*b*). It is clear that also other elaborations are possible for mutually adjusting the positions of the clamping elements 24, 25. Here, for instance, a bearing frame can be conceived that is provided with a guide with which a first set of clamping elements and a second set of clamping elements are movably connected to each other so that the mutual distance between the two sets can be adjusted. Here, the position of the guide itself with respect to the solid world can also be variable, so that the patient can be tilted through tilting the guide. It will be clear that with such a configuration, the patient can also be brought from a seated to a lying position and vice versa. All this is possible while maintaining a firm clamping and the paths of the trunk and the upper legs are accurately defined by the paths travelled by the first set and the second set of clamping elements.

It will be clear that the invention is not limited to the exemplary embodiments represented here, but that within the framework of the accompanying claims, numerous variants are possible. For instance, the base structure of the hoist can also be attached to the ceiling or to a wall. In order to make the base structure moveable on the ceiling, the base structure may be wheeled along a rails provided against or in the ceiling.

The invention claimed is:

1. A hoist for moving persons, comprising:

a base structure;

one lifting column having a straight longitudinal axis and a lower end and which is provided with a first actuator for realizing a lifting movement;

a clamping device which comprises:

a bearing frame connected to the lifting column, such that the bearing frame and hence the clamping device is movable parallel to the longitudinal axis with the aid of the first actuator;

at least one set of cooperating clamping elements connected to the bearing frame and designed for clamping a person to be moved, wherein at least one clamping element of the set is pivotally connected to the bearing frame, and a driving device connected to the bearing frame and to the at least one pivotal clamping element, designed for pivoting the at least one pivotal clamping element in the direction of the person for actively clamping the person with the cooperating clamping elements;

a horizontal shaft with which the lifting column is pivotally connected to the base structure;

a second actuator connected to the lifting column and to the base structure, and configured for varying the pivotal position of the lifting column with respect to the base structure; and a control device configured to control the first actuator and the second actuator to move a clamped person according to a natural path from a seated position to a standing position and vice versa.

2. The hoist according to claim 1, wherein the control device and the first and the second actuator are configured for providing the natural path in the form of a smooth path.

3. The hoist according to claim 2, wherein the smooth path from the seated to the standing position comprises:

a first path part which, viewed from the patient, is directed forward and obliquely upward or, alternatively, forward and substantially horizontally; and a second path part contiguous to the first path part, which is directed substantially vertically, while the transition between the first path part and the second path part is smooth.

4. The hoist according to claim 1, wherein the control device is provided with a memory in which a number of preprogrammed paths are stored.

5. The hoist according to claim 1, wherein the driving device of the clamping device comprises at least one first driving element for moving the at least one clamping element against the person to be moved, and wherein the driving device comprises at least one second driving element for exerting a force directed towards the person to be moved on the clamping element positioned against the person to be moved for actively clamping the person.

6. The hoist according to claim 5, wherein the at least one second driving element of the clamping device is designed for exerting a greater force directed towards the person to be moved on the clamping element than the force that can be exerted on the clamping element by the at least one first driving element.

7. The hoist according to claim 6, wherein the first driving element and the second driving element of the clamping device are separately activatable.

8. The hoist according to claim 6, wherein the first driving element comprises, for each clamping element, a third, telescopic actuator associated with the respective clamping element, which is connected by one end to the bearing frame and by the other end to the clamping element, wherein the third actuator has a collapsed and extended position between which intermediate positions are located, wherein the third actuator is provided with a locking device that locks the third actuator in an intermediate position.

9. The hoist according to claim 8, wherein each third actuator is of the gas spring type.

10. The hoist according to claim 8, wherein the second driving element comprises:

a shaft which is rotatably connected to the bearing frame and has a first eccentric lobe and at least one second eccentric lobe associated with the at least one clamping element, wherein the first end of the third actuator associated with a clamping element is connected via the second lobe to the bearing frame; and a fourth telescopic actuator which is connected by a first end to the first eccentric lobe and is connected by a second end to the bearing frame;

wherein, with the fourth actuator in a first condition, the shaft has a rotational position such that with each third actuator in a locked condition, the greater force directed towards the person to be moved is exerted on the clamping element and wherein with the fourth actuator in a second condition, the shaft has a rotational position such that with each third actuator in a locked position, the force substantially corresponds to the force which is exerted by the at least one third actuator on the clamping element when this third actuator would be in the unlocked condition.

11. The hoist according to claim 1, wherein the at least one set of cooperating clamping elements comprises at least two clamping elements pivotally connected to the bearing frame, and wherein the driving device is designed for pivoting the two pivotal clamping elements towards the person, thereby clamping the person, wherein the pivots of the pivotal clamping elements extend substantially parallel to the longitudinal axis of the lifting column.

12. The hoist according to claim 1, wherein at least one clamping element comprises an arm and a pad connected to the arm, wherein the pad is designed for engaging the person to be moved, wherein at least a part of the pad facing the person is of substantially flexible design.

13. The hoist according to claim 12, wherein the orientation of the path with respect to the arm is adjustable.

14. A method for moving persons, comprising:

providing a hoist according to claim 1, having the clamping elements engage a person to be moved, having the driving device exert a force directed towards the person to be moved on the at least one pivotal clamping element thereby clamping the person, and moving the person clamped by the clamping device.

15. The hoist according to claim 2, wherein the control device is provided with a memory in which a number of preprogrammed paths are stored.

16. The hoist according to claim 3, wherein the control device is provided with a memory in which a number of preprogrammed paths are stored.

17. A hoist according to claim 2, wherein the driving device of the clamping device comprises at least one first driving element for moving the at least one clamping element against the person to be moved, and wherein the driving device comprises at least one second driving element for exerting a force directed towards the person to be moved on the clamping element positioned against the person to be moved for actively clamping the person.

18. The hoist according to claim 1, wherein the control device is configured to control the first actuator to move the bearing frame of the clamping device along the lifting column, and control the second actuator to vary a pivotal movement of the lifting column with respect to the base structure.

* * * * *

UNITED STATES PATENT AND TRADEMARK OFFICE

CERTIFICATE OF CORRECTION

PATENT NO. : 8,650,677 B2
APPLICATION NO. : 12/937497
DATED : February 18, 2014
INVENTOR(S) : Altena et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 589 days.

Signed and Sealed this
Twenty-ninth Day of September, 2015

Michelle K. Lee

Michelle K. Lee
*Director of the United States Patent and Trademark Office*